US005653413A

United States Patent [19]

Fink

[11] Patent Number: 5,653,413

[45] Date of Patent: Aug. 5, 1997

[54] PIVOTABLE, STOWABLE, KEYBOARD SHELF FOR APRON BANDED TABLE

[76] Inventor: Bernard Fink, 3611 Garden St., Santa Cruz, Calif. 95062-3222

[21] Appl. No.: 415,670

[22] Filed: Apr. 3, 1995

[51] Int. Cl.[6] ..... A47F 5/00

[52] U.S. Cl. ..... 248/286.1; 248/284.1; 248/918

[58] Field of Search ..... 248/291.1, 286.1, 248/292.13, 292.14, 918, 284.1; 108/2, 5, 6, 138, 143; 312/223.3, 223.2, 302, 313, 334.4

[56] References Cited

U.S. PATENT DOCUMENTS

| | | | |
|---|---|---|---|
| 3,866,866 | 2/1975 | Kneile | 248/918 X |
| 4,923,259 | 5/1990 | Bartok | 108/143 |
| 5,098,053 | 3/1992 | Cotterill | 108/6 X |
| 5,106,003 | 4/1992 | Ma | 248/292.14 X |
| 5,145,136 | 9/1992 | McConnell | 248/286 X |
| 5,257,767 | 11/1993 | McConnell | 248/918 X |
| 5,294,087 | 3/1994 | Drabczyk et al. | 248/918 X |
| 5,443,237 | 8/1995 | Stadtmauer | 248/918 X |
| 5,513,579 | 5/1996 | Allan | 248/918 X |

*Primary Examiner*—Ramon O. Ramirez

[57] ABSTRACT

A computer keyboard shelf for users of large data display monitors. The computer keyboard is positioned in front and just below the table top when in use. For storage, a fingerpull unlatches the shelf permitting the shelf to swing down and under the top of the apron banded table. When in the "stow" position, the keyboard is fully concealed and shielded from damage or collecting dust. In the "use" position, the hands operating the keyboard are below the elbows which is an ergonomically advantageous position.

5 Claims, 7 Drawing Sheets

PIVOTABLE, STOWABLE, KEYBOARD SHELF FOR APRON BANDED TABLE

BACKGROUND OF THE INVENTION

Current Computer keyboards rest on either a desk or table. Some designs have the keyboard on a sliding shelf that allows storage under a table or desk. These require the omission of an apron or channel stiffener that is so desirable for large heavy monitors. A sliding drawer under the monitor is available for lightweight or small monitors. Some tables have a fixed lower shelf. These tables of course cannot stow the keyboard or protect it. Keyboard usage on a table or desk present the keyboard at a height above the elbows, thereby causing potential pain from intensive use over time. The permanent exposure of the keyboard also naturally collects much dust. Most of all, when used in conjunction with a large monitor the normal table or desk depth has insufficient space for proper location of the keyboard. The user needs to position his eyes a suitable distance from the monitor screen while accessing the computer keyboard. Large monitors are quite heavy and ideally should rest on an apron banded table to preclude table sag. A sliding shelf cannot be installed on an apron banded table unless positioned below the apron or channel. This puts the keyboard too low for ideal use, and it is still exposed to dust. An extra deep table or desk can be used to eliminate the distance problem. A keyboard under the monitor is only suitable for use with small or light weight monitors.

My configuration overcomes all these deficiencies without wasting office space for an extra deep desk or table. Commercial graphic CAD programs require large monitors (approximately 21 inch size) that rest on sturdy platforms that can withstand the weight of books or other equipment without fear of damage or sagging. The benefits of my configuration will become more obvious upon examination of the multiple figures of the drawings and in view of the detailed description.

BRIEF DESCRIPTION OF THE DRAWINGS

FIG. 15(*a*) is a detail view of the keyboard forward mounting means.

FIG. 15(*b*) is a detail view of an alternate keyboard forward mounting means.

DETAILED DESCRIPTION OF THE PREFERRED EMBODIMENT

Figure 1:
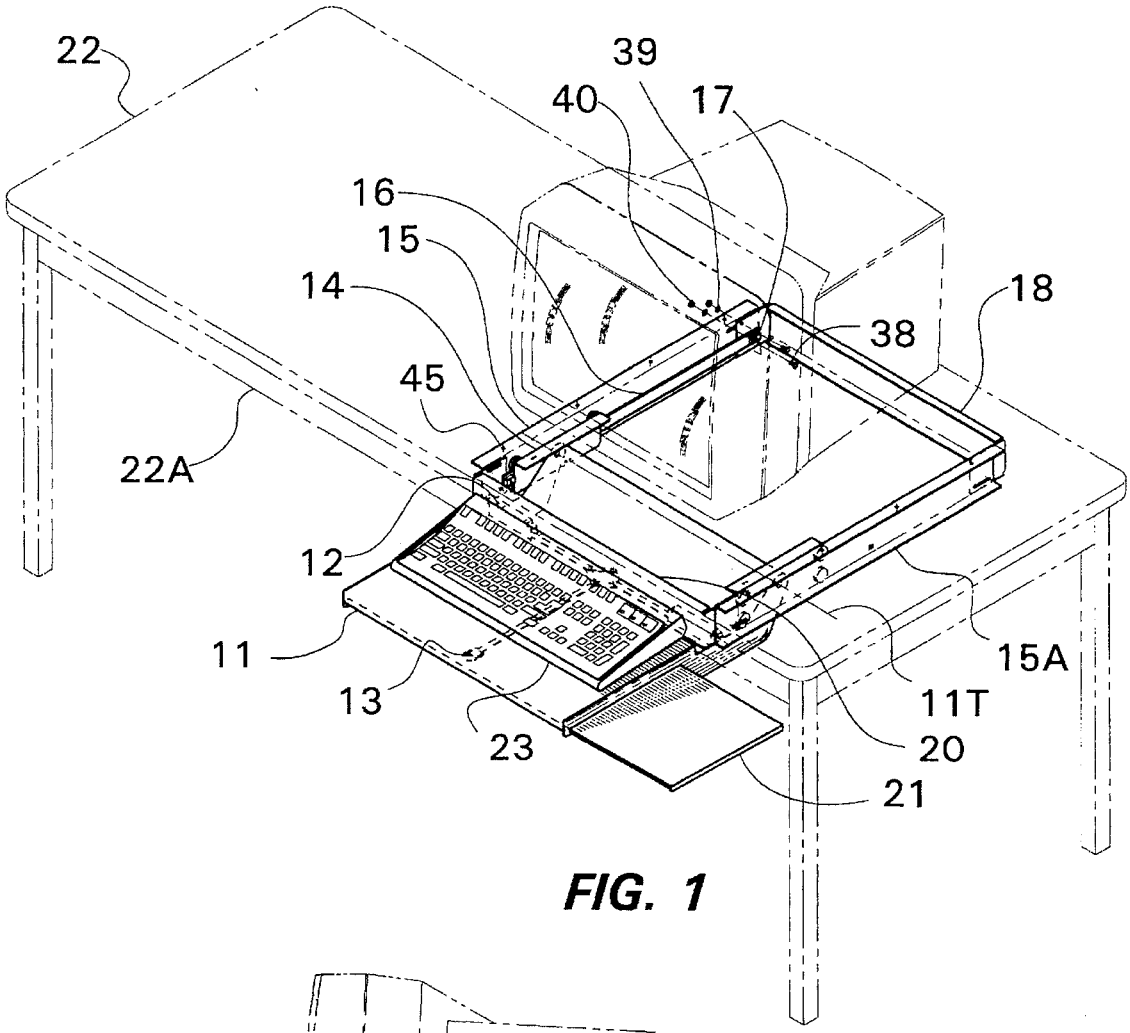
FIG. 1 is a top perspective view showing the keyboard shelf of the present invention, and shows an apron banded table and large monitor in phantom.
Figure 10:
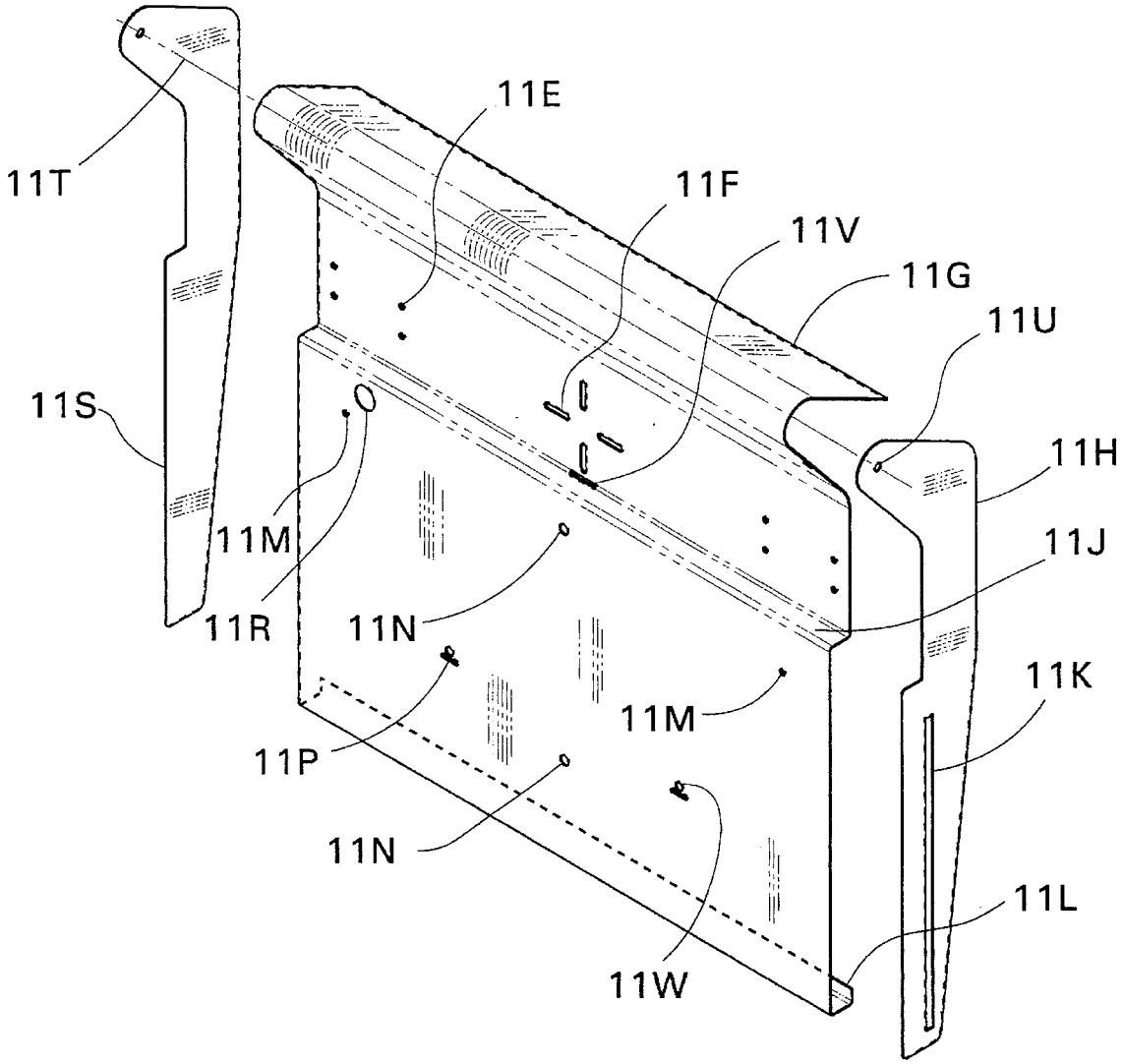
FIG. 10 is an exploded view of the pivotable deck.

Referring first to FIGS. 1 and 10, the present invention is a keyboard deck or shelf 11 comprising profile end plate 11S, a profile end plate 11H with tray aperture 11K and a keyboard deck form 11G. When assembled, these elements provide a pivotable deck for the keyboard via pivot axis 11T. Two slots 11P and two holes 11W provide a position for two forward hold down leaf springs 28.

Figures 9, 14, 15A, 15B, 16:
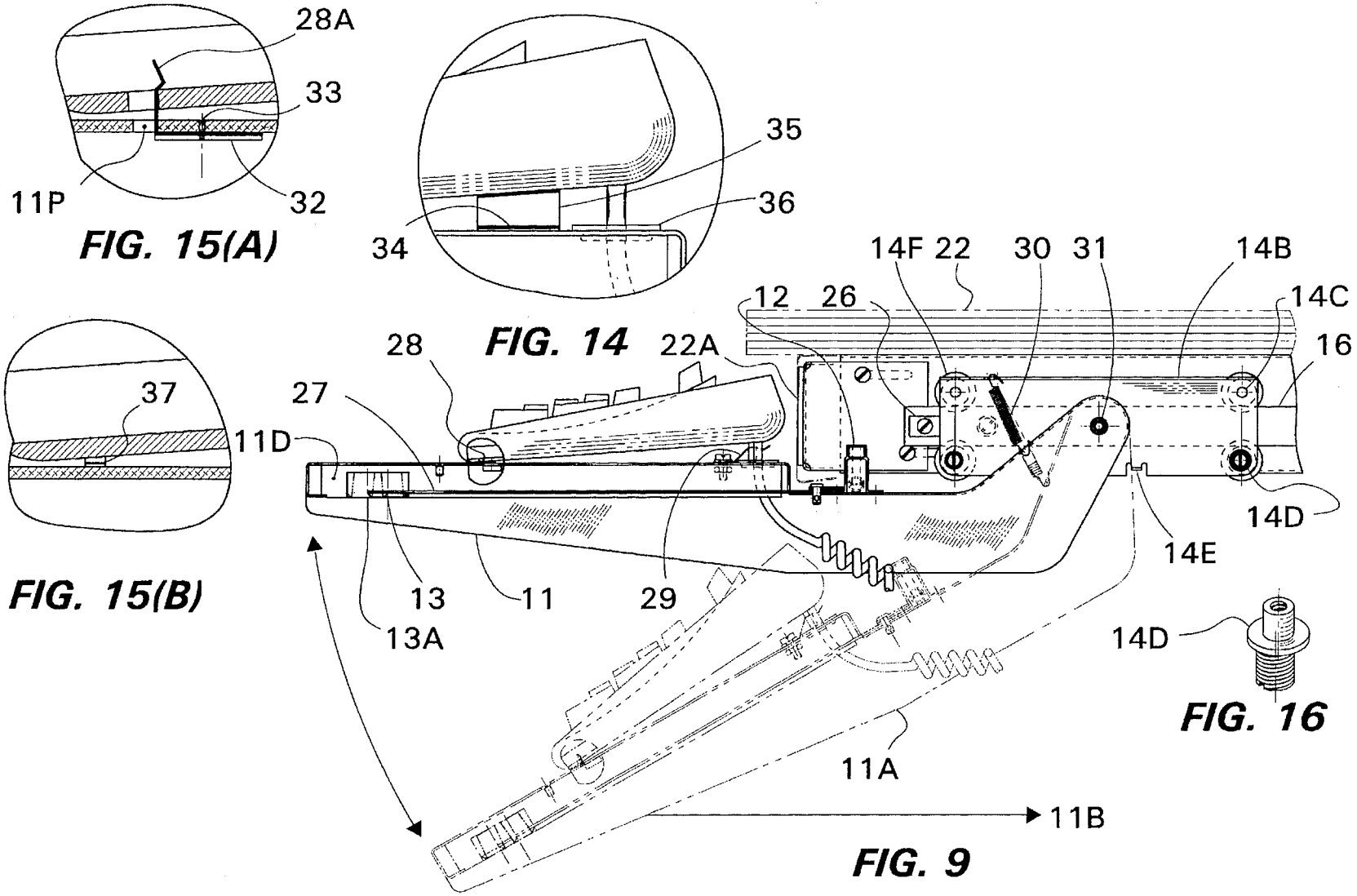
FIG. 9 is a detailed view of the area in FIG. 2 designated as "9".
FIG. 14 is a detail view of an alternate keyboard aft mounting means.
FIG. 16 is a detail view of the adjustable axle.

Referring now also to FIG. 15A, a screw 33 and plate nut 32 secure the hold down leaf springs 28 which are formed with a V tab 28A so as to engage apertures in the forward locations within the keyboard 23 in a snap fit fashion. FIG. 10 shows two aft spring holes 11M which allow mounting of two aft leaf springs 29 which have a cantilevered leg so as to-engage apertures in the forward legs of the keyboard 23. An axis hole 11U in end plates or side arms 11S and 11 H is provided for mounting the deck pivotally about axis 11T within carriage plates 14B. Two pivot shoulder bolts and jam nuts hardware 31 are utilized. A step 11J on deck form 11 G positions the keyboard at the proper height for usage and so as to clear the Table Channel 22A. Proper nesting of the deck 11 under the table 22 when the shelf is "stowed" is insured by the appropriate location of the shelf axis 11T in gantry assembly 14. Two mounting holes 11N are provided to mount pull rod guide 11D with two screws. Two threaded holes 49 within the guide secure the guide to the deck 11. Four holes 11E on each side of deck form 11G receive screws and nuts to mount a latch assembly housing 12. Four slots 11F positioned symmetrically about the center of deck form 11G provide a clearance for the scissors pins 25A. Flange 11L supports the forward end of guide 11D while adding structural stiffness. Scissors pins 25A are headed on one end and retained with a cotter pin on the opposite end. Slot 11V at the bottom of step 11J provides access for pull rod 27 to slide through steps 11J, thereby allowing pull rod 27 to act upon scissors assembly 25 which is connected to pull rod 27. A feedthru hole 11R that receives grommet 36 in deck 11G allows a larger expansion coil portion of a keyboard cable to feed through to the bottom of the shelf.

Figure 6:
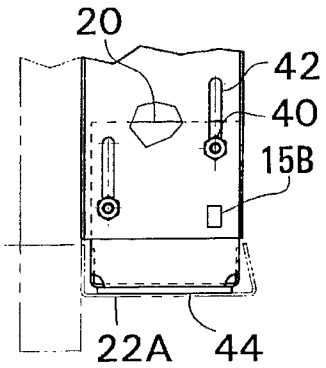
FIG. 6 is a side view of the area shown in FIG. 5.

Side rails or tracks 15 and 15A are a pair (left hand and right hand parts) of channel rails. They are connected to rear rail 18 and front rail 20 to form a rail frame. The front and rear rails have flanges 20 and 43 respectively with holes 41 to attach the side rails through slots 42 within the side rails. Screws 38, washers 39, and nuts 40 secure the rail frame. Holes 45 in the side rails allow attaching screws to fasten the frame to the table bottom. Rubber pads 44 are bonded to the front and rear rails. Mating slots in side rails 15 and 15A provide ease of installation and a means of expansion. Forward apertures 15B in side rails and front rails (shown in FIG. 6) must be aligned. This will insure free passage of latch pin 12A within said apertures 15B. The rails 15, 15A, 18 and 20 are installed to fill the space between the front and rear table aprons 22A (channels). The aft apertures 15C in side rails 15 and 15A are aligned with forward apertures 15B.

Figure 2:
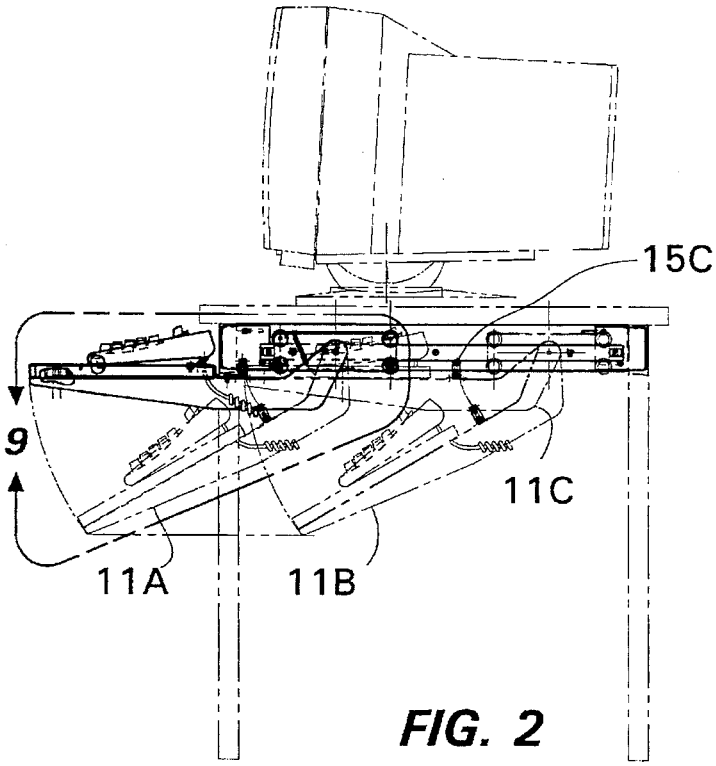
FIG. 2 is a side view that shows the keyboard shelf in the "Use" position. The two "Transition" positions and the "Stowed" position are shown in phantom.
Figure 3:
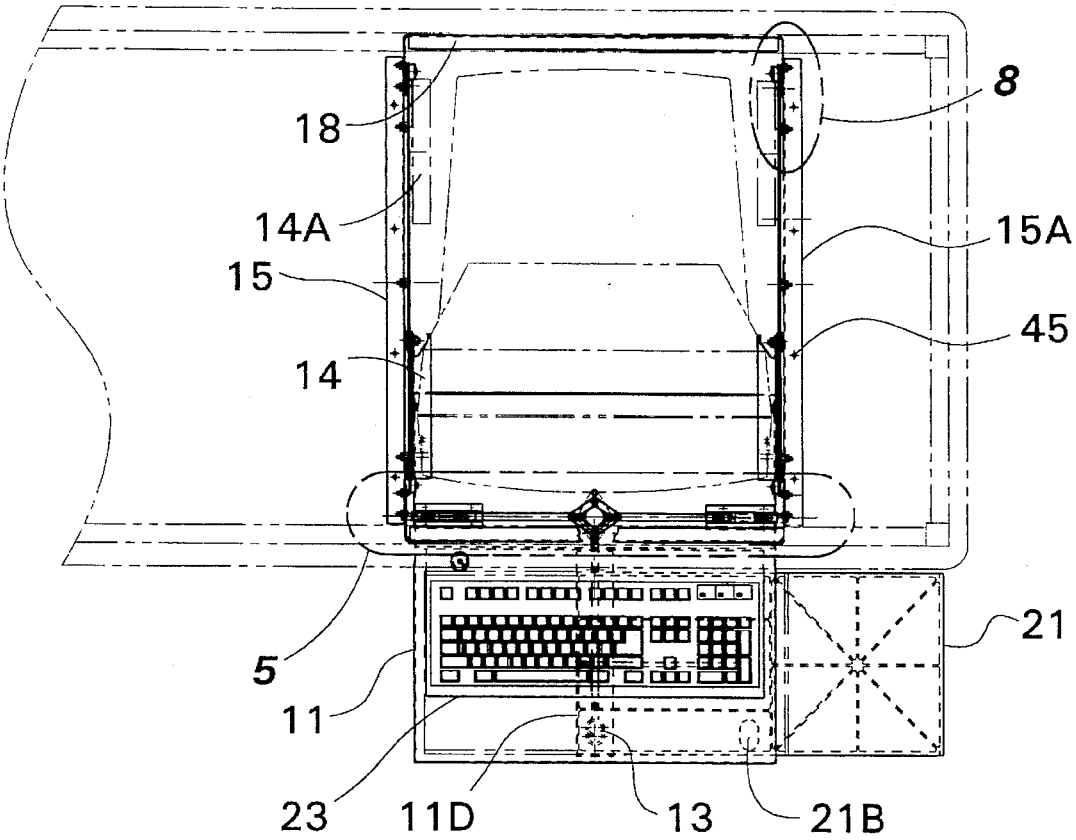
FIG. 3 is a top view of the present invention showing a partial table in phantom.
Figure 4:
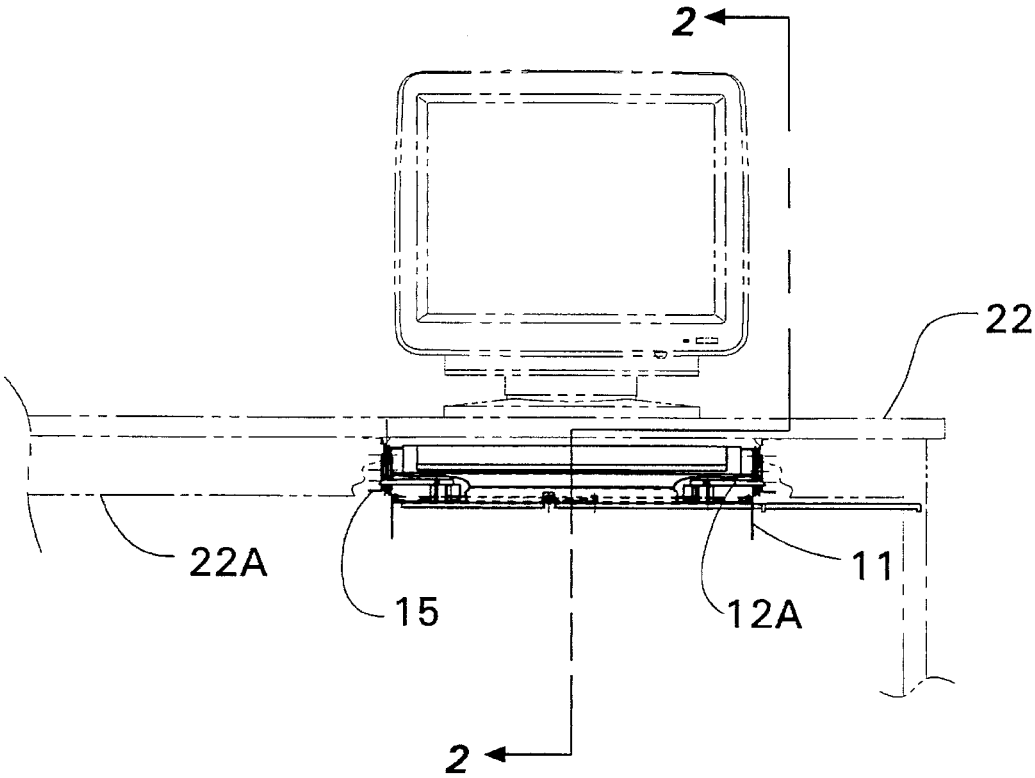
FIG. 4 is a front view of the keyboard shelf and shows the partial table and monitor in phantom.

Referring now to FIG. 2, the aft apertures 15C are positioned so that when the gantry 14 is at an aft stop 17, and the shelf is lifted, latch pins 12A enter the aft aperture 15C in each said side rail, thus establishing the "stowed" position. Latch pins 12A are biased by springs 12B so that the latch pins will engage the apertures. The latch pins 12A are connected to the scissors assembly 25 by latch extenders 24, latch block 12C, and pins 12D and 12E.

The gantry 14 (see FIG. 9) comprises wheels 14F, two (left and a right) carriage plates 14B, two axles 14C, two adjustable axles 14D and appropriate retaining screws and jam nuts to assemble said wheels and axles to said carriage plates. The adjustable axles 14D have a wheel mounting diameter on one end that is eccentric to a threaded diameter on the opposite end. A shoulder separates the two said diameters as shown in FIG. 16 so the jam nut can secure the axel shoulder against the outer face of the carriage plate. The adjustable axles 14D are adjusted using a screwdriver in an axle slot on one end of the axle. By changing the azimuth of the threaded diameter within the slip fit bore of the carriage plates the eccentric wheel mounting diameter can be set to a more precise fit for the lower wheel to guide clearance. This of course is done to minimize the clearance between the wheel and guide while allowing free traverse of the gantry through the gantry guides. The 14C axels are similar except that the two end diameters are concentric. The jam nut secures each axel in place. A swing down limit tab 14E limits the shelf pivot angle. Two springs 30 urge the deck 11 toward a horizontal position.

The gantry 14 is fastened to the shelf at the shelf axis 11T, by a shelf pivot shoulder bolt and jam nut hardware 31. The gantry guides 16 have upper and lower V-shaped profiles to match that of the grooves within wheels 14F. The guides are fastened to rails with screws and spacers 16A. The forward limit stop 26 and rear limit stop 17 are each fastened with a screw into a tapped hole provided at the front and rear end of each of the gantry guides respectively.

Figure 11:
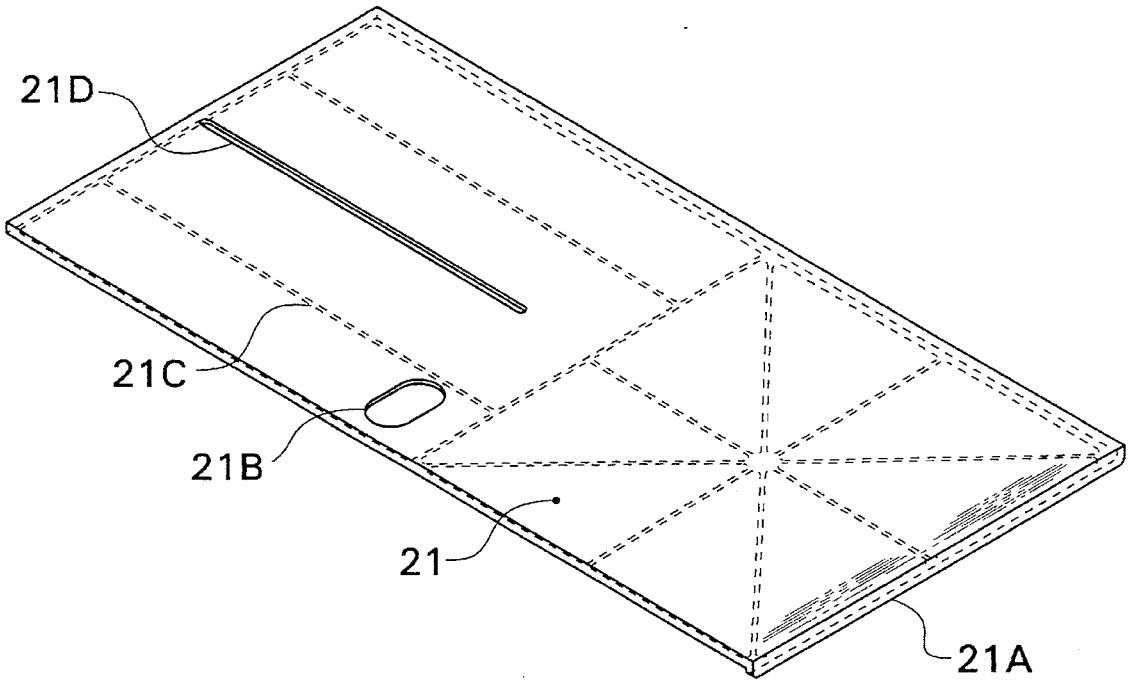
FIG. 11 is a perspective view of the retractable mouse tray.
Figure 13:
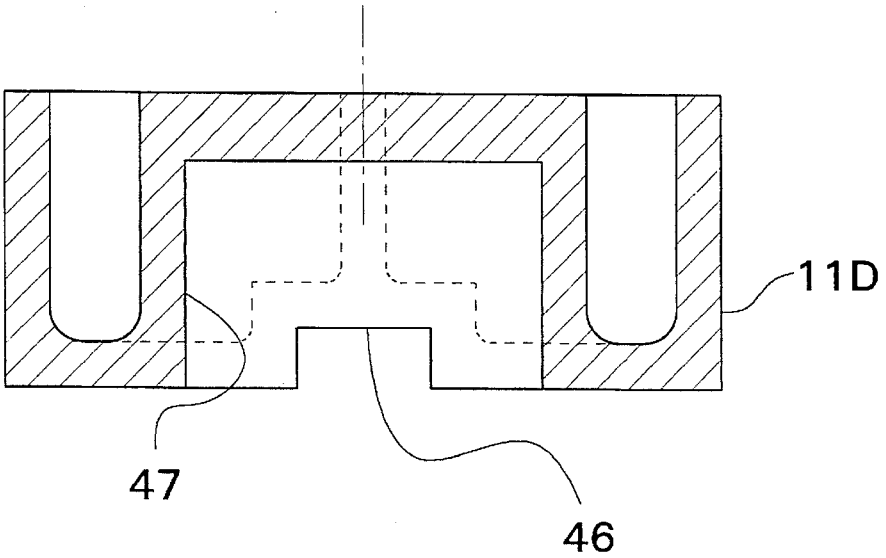
FIG. 13 is a cross section of the pull rod guide taken along line 13—13 in FIG. 12.
Figure 12:
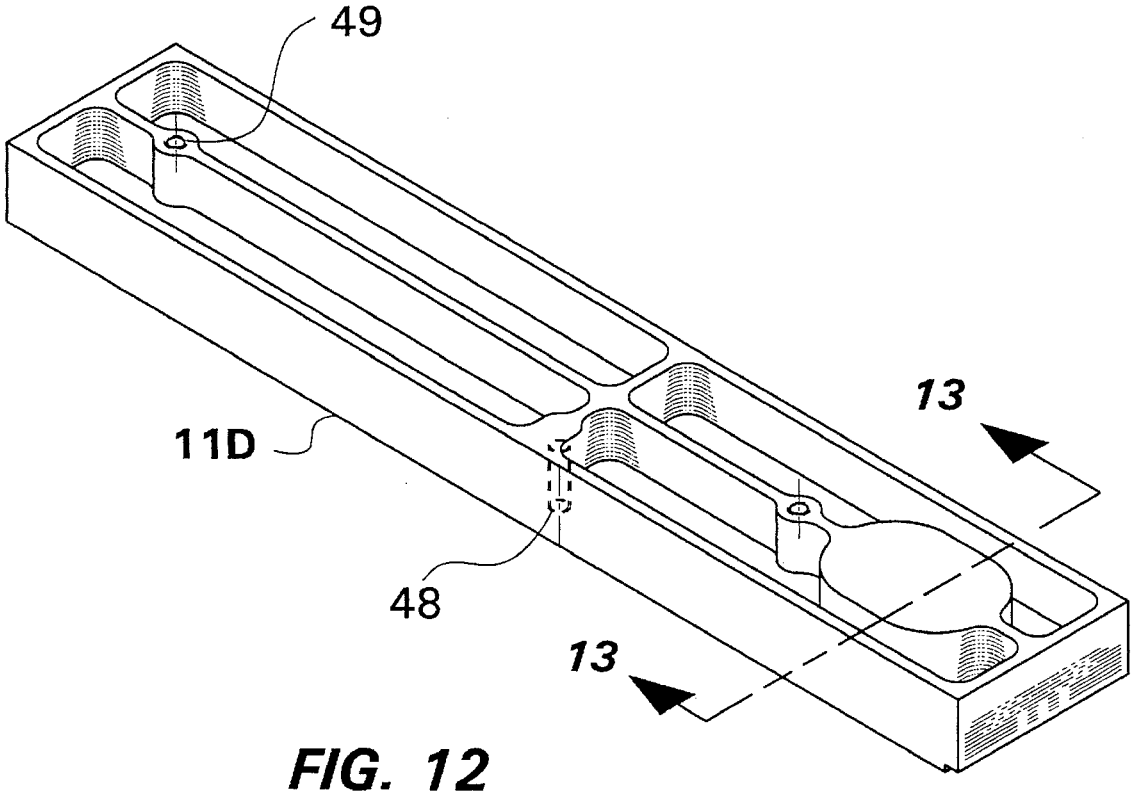
FIG. 12 is a perspective view of the pull rod guide.

A retractable mouse tray 21, shown in FIG. 11 includes a slot 21D. A screw passing through slot 21D is secured to pull rod guide 11D at threaded hole 48. This permits the mouse tray 21 to traverse the distance of slot 21 D. An opening 21 B is sized to match the travel path of fingerpull 13 from its at rest position to position 13A. Slot 21B is located so as to require full retraction of mouse tray 21 before the user can access fingerpull 13. This minimizes the chance of the mouse tray striking the table during the transition operation. The mouse tray 21 also serves to retain fingerpull 13 within a slotted cavity 46 of pull rod guide 11 D. The mouse tray 21 has a pull flange 21A and stiffening ribs 21C.

An alternate means of positioning the keyboard on the shelf 11 is depicted in FIGS. 14 and 15B, and is as follows: The aft legs of keyboard are retracted or removed. Two plastic blocks 35 fitted with an adhesive pad to the keyboard side and a Velcro hook pad on the opposite side set to a mating Velcro loop pad 34 bonded to the shelf, serve to locate the aft portion of the keyboard. The blocks of course, should have a taper to match the original keyboard angle. Two adhesive backed Velcro hook disks 37 can be fixed to the keyboard forward foot pads with mating Velcro loop disks affixed to the coincident locations on the shelf to locate the forward portion of the keyboard. Alternate locations of feedthru hole 11R can also be provided in the deck 11 for keyboards whose cable exits closer to those locations. Dummy fill plugs can be provided for the unused holes, as is a common practice.

Figure 5:
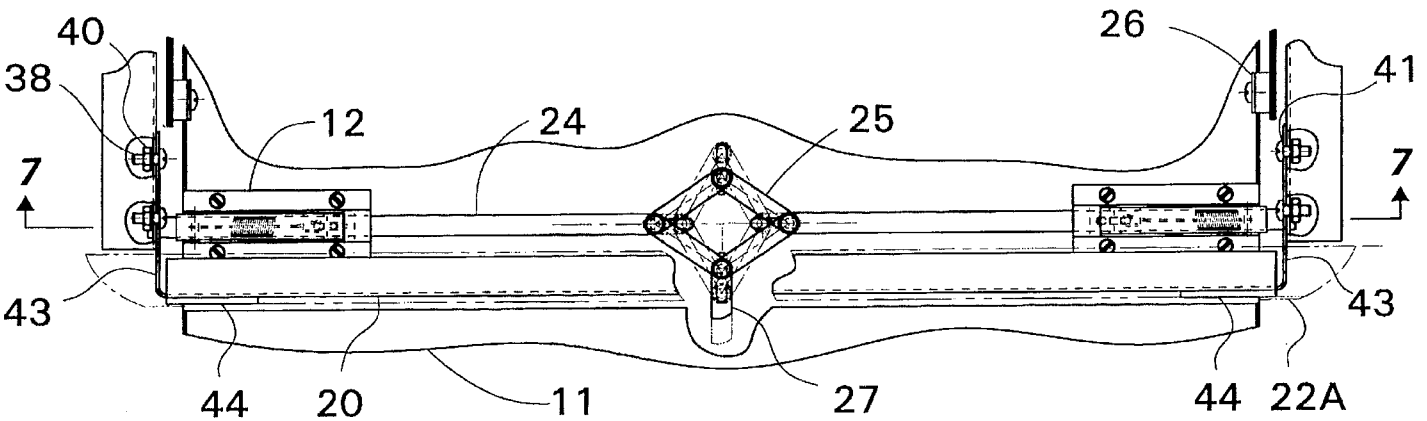
FIG. 5 is a detailed view of the area in FIG. 3 circled and labeled "5"
Figure 7:
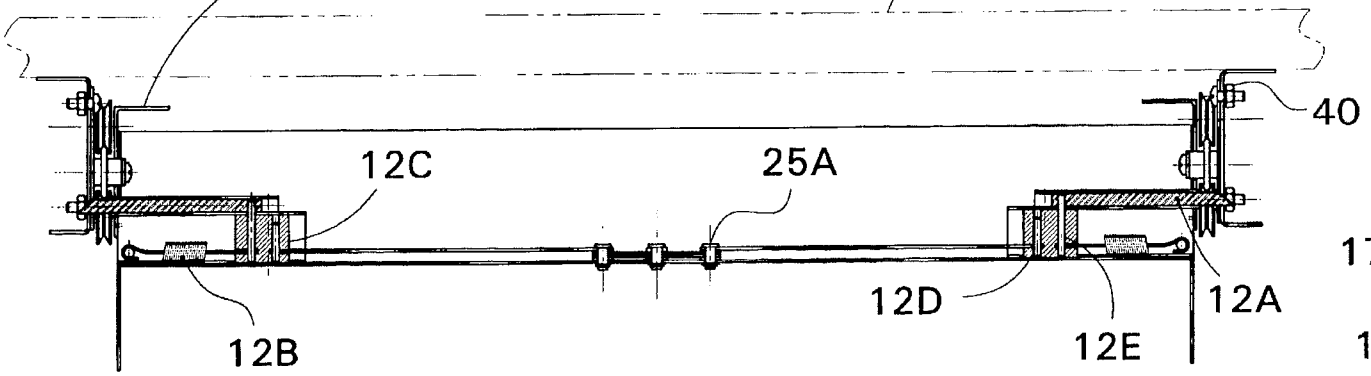
FIG. 7 is a cross section taken along line 7—7 in FIG. 5.
Figure 8:
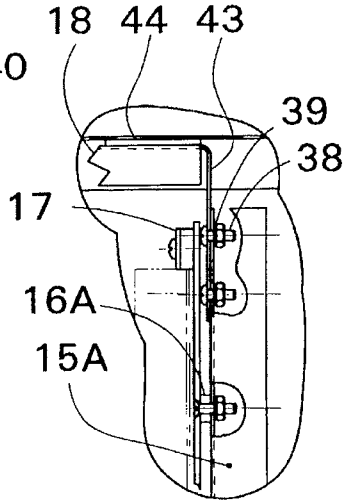
FIG. 8 is a detailed view of the area in FIG. 3 circled and labeled "8".

Operation of the keyboard shelf is as follows: Referring to FIG. 2 for depiction of the various positions of the shelf, FIG. 2 shows the shelf in an "in use" position. In this position, the gantry 14 is in a front section of the rail frame. Latch pint 12A are secured in forward apertures 15B. The scissors assembly 25 is in its expanded position as shown in FIG. 5.

To stow the shelf, the user pulls on the fingerpull 13. This causes the fingerpull 13 to move toward the user within the elongated pocket 47 located in guide 11D, thereby also moving the pull rod 27, which is secured in the fingerpull guide, toward the user. This compresses the scissors mechanism 25, as shown in phantom in FIG. 5, overcoming the biasing force of springs 12B, allowing the latch pins 12A to withdraw from the forward apertures 15B. The keyboard deck 11 is then free to swing down to the first lowered position 11A shown in phantom in FIG. 2. The deck 11 is prohibited from moving past this position by contacting the limit tabs 14E of the profile end plates 11S and 11H. The swing down of the shelf is slowed by the biasing action of springs 30.

The user then pushes the shelf so that the gantry 14 moves to the rear of the rail frame, the wheels 14F moving about the V-form of the gantry guides 16. When the shelf reaches the rear lowered position 11 B, also shown in phantom in FIG. 2, the shelf is ready to be stowed. To stow the shelf, the user lifts the keyboard deck to a horizontal position. The user then releases the fingerpull 13 so that the biasing force of springs 12B pulls the latch pins 12A outward, thereby causing the latch pins 12A to be received in aft apertures 15C. This locks the shelf in the stowed position, also shown in phantom in FIG. 2.

I claim:

1. A device for supporting a keyboard in a first position where the key board is accessible to an operator using the keyboard extended in front of a work table together with a monitor positioned on a top surface of said work table and in a second position where the keyboard is stowed under and proximal to said top surface, said device comprising;

a shelf means adapted for supporting said keyboard on an upper surface of said tray means;

said shelf tray means being substantially rectangular with an under surface opposite said upper surface and having a pair of side edges, one side edge of said pair of side edges parallel to and opposite another side edge of said pair of side edges and a front edge parallel to and opposite a rear edge;

a pair of elongated side arms one side arm of said pair of elongated side arms secured to said shelf means along said one side edge and another side arm of said pair of elongated side arms secured to said shelf means along said another side edge;

a pair of parallel track means adapted for being fastened on a bottom surface of said work table opposite said top surface for slidably supporting a pair of gantry means to slide in a direction parallel to said top surface and perpendicular and proximal to a working edge of said work table;

a pair of gantry means, one gantry means of said pair of gantry means slidably engaged in one track means of said pair of track means and another gantry means engaged in said another track means of said pair of track means for rotatably supporting ends of said elongated support arms;

means for rotatably securing said one side arm to said one gantry means proximal to said rear edge of said tray;

means for rotatably securing said another side arm to said another gantry means proximal to said rear edge of said tray rotates about an axis that is parallel to said rear edge of said shelf and said working edge of said work table;

each track means of said pair of track means having a forward aperture in a location proximal to said working edge of said top surface and a rear aperture in a location distal from said working edge of said top surface;

one guide rod axially slidably mounted on and parallel to said under surface of said shelf means and positioned for a near end of said one guide rod to slide into and out of engagement in one of said forward apertures when said shelf means is in said first position and to slide into and out of engagement with one of said rear apertures when said shelf means is in a second position;

another guide rod axially slidably mounted on and parallel to said under surface of said shelf means and positioned for a near end of said another guide rod to slide into and out of engagement with another one of said forward apertures when said shelf means is in said first position and to slide into and out of engagement with another one of said rear aperture when said shelf means is in said second position;

means for slidably positioning said one guide rod and said another guide rod into and out of said apertures respectively;

spring means for biasing said one guide rod and said another guide rod into engagement with respective aperture wherein said pair of gantry means is enabled to be slid to a first location with said shelf means extended from top surface of said work table and is accessible to said user and detachable securing said shelf means in said second position and wherein said pair of gantry means is enabled to be slid to a second location with said shelf means stowed under said top surface of said work table.

2. The device of claim 1 wherein said work table has an apron and said device comprises said elongated arms and shelf means being operably configured with a shape such that when said shelf is in said first location, said keyboard is located substantially on a level with underside of said work surface and when said shelf is in said second position said keyboard is on a level proximal to an underside of said work surface.

3. The device of claim 1 wherein said means for slidably positioning comprises:

a frame having four legs, each leg rotatably attached to an end of a neighboring leg such that said frame has four corners;

said frame mounted on said shelf means with one corner of said frame secured to a far end of one guide rod and an opposite corner of said frame secured to a far end of said another guide rod distal;

a pull strap having one end accessible to said user and another end coupled to said frame operably arranged such that, when said user pulls said strap, said end near of said one guide rod and said near end of said another guide rod are both disengaged from said respective apertures.

4. The device of claim 3 which comprises:

a mouse tray means for supporting a mouse;

a slot in at least one of said elongated arms;

said slot and mouse tray constructed in operable combination to permit sliding said mouse tray into said slot and adapted to support a mouse.

5. A device for supporting a keyboard in a first position where the keyboard is accessible to an operator using the keyboard extended in front of a work table having a table top with a top surface together with a monitor positioned on said top surface of said work table and in a second position where the keyboard is stowed under and proximal to said top surface, said device comprising:

a shelf means adapted for supporting said keyboard on an upper surface of said tray means;

said shelf means being substantially rectangular with an under surface opposite said upper surface and having a pair of side edges, one side edge of said pair of side edges parallel to an opposite another side edge of said pair of side edges and a front edge parallel to an opposite a rear edge;

a pair of elongated side arms, one side arm of said pair of elongated side arms secured to said shelf means along said one side edge and another side arm of said pair of elongated side arms secured to said shelf means along said another side edge;

a pair of parallel track means adapted for being fastened on a bottom surface of said work table opposite said top surface for slidably supporting a pair of gantry means to slide in a direction parallel to said top surface and perpendicular and proximal to a working edge of said work table;

a pair of gantry means, one gantry means of said pair of gantry means slidably engaged in one track means of said pair of track means and another gantry means engaged in said another track means of said pair of track means for rotatably supporting ends of said elongated support arms;

means for rotatably securing said one side arm to said one gantry means proximal to said rear edge of said tray;

means for detachably securing said shelf in said first position wherein said pair of gantry means is slid to a first location with said shelf means extended from said top surface of said work table and is accessible to said user and for detachably securing said shelf means in said second position wherein said pair of gantry means is slid to a second location with said shelf means stowed under and against said table top of said work table.

* * * * *